US005097731A

United States Patent [19]

Vives et al.

[11] Patent Number: 5,097,731

[45] Date of Patent: Mar. 24, 1992

[54] METHOD AND APPARATUS FOR CUTTING UP FIXED LAYERS OF FLEXIBLE MATERIAL USING A HIGH PRESSURE WATER JET

[75] Inventors: Michel Vives, Eysines; Pierre Daubigny, Saint Medard en Jalles; Claude Ruet, Martignas, all of France

[73] Assignee: Societe Europeenne De Propulsion, Suresnes, France

[21] Appl. No.: 568,417

[22] Filed: Aug. 16, 1990

[30] Foreign Application Priority Data

Aug. 17, 1989 [FR] France ..... 89 10989

[51] Int. Cl.[5] ..... B24C 1/00; B24C 3/02

[52] U.S. Cl. ..... 83/53; 83/27; 83/177; 83/861; 83/102.1; 51/439

[58] Field of Search ..... 30/123.3; 83/169, 53, 83/27, 102.1, 177, 870, 861; 51/410, 439; 299/17, 23, 81; 175/424

[56] References Cited

U.S. PATENT DOCUMENTS 4,226,005 10/1980 Meyers ..... 17/1 R
4,265,487 5/1981 Barker ..... 299/34
4,280,735 7/1981 Löbbe ..... 299/17 X
4,532,949 8/1985 Frank ..... 83/53
4,652,056 3/1987 Parrott et al. ..... 299/17 X
4,669,229 6/1987 Ehlbeck ..... 83/53
4,733,914 3/1988 Kogelmann ..... 299/17 X
4,872,293 10/1989 Yasukawa et al. ..... 83/53
4,902,073 2/1990 Tomlinson et al. ..... 299/17 X
4,934,111 6/1990 Hashish et al. ..... 83/53

FOREIGN PATENT DOCUMENTS 2027776 2/1980 United Kingdom .
2180142 3/1987 United Kingdom .

*Primary Examiner*—Hien H. Phan
*Assistant Examiner*—Raymond D. Woods
*Attorney, Agent, or Firm*—Weingarten, Schurgin, Gagnebin & Hayes

[57] ABSTRACT

A method and apparatus for cutting up thick layers of fibrous material, the apparatus comprising a base to which a blade is fixed. The end of the blade carries a nozzle which emits an ultrafast fine water jet when fed with water under pressure via a duct. On each cutting pass, an additional thickness (H) of the layer is cut while the flanks of the cut that has already been made are held apart from each other by the blade, thereby ensuring that the jet is not disturbed by the flanks and retains its full cutting power.

13 Claims, 3 Drawing Sheets

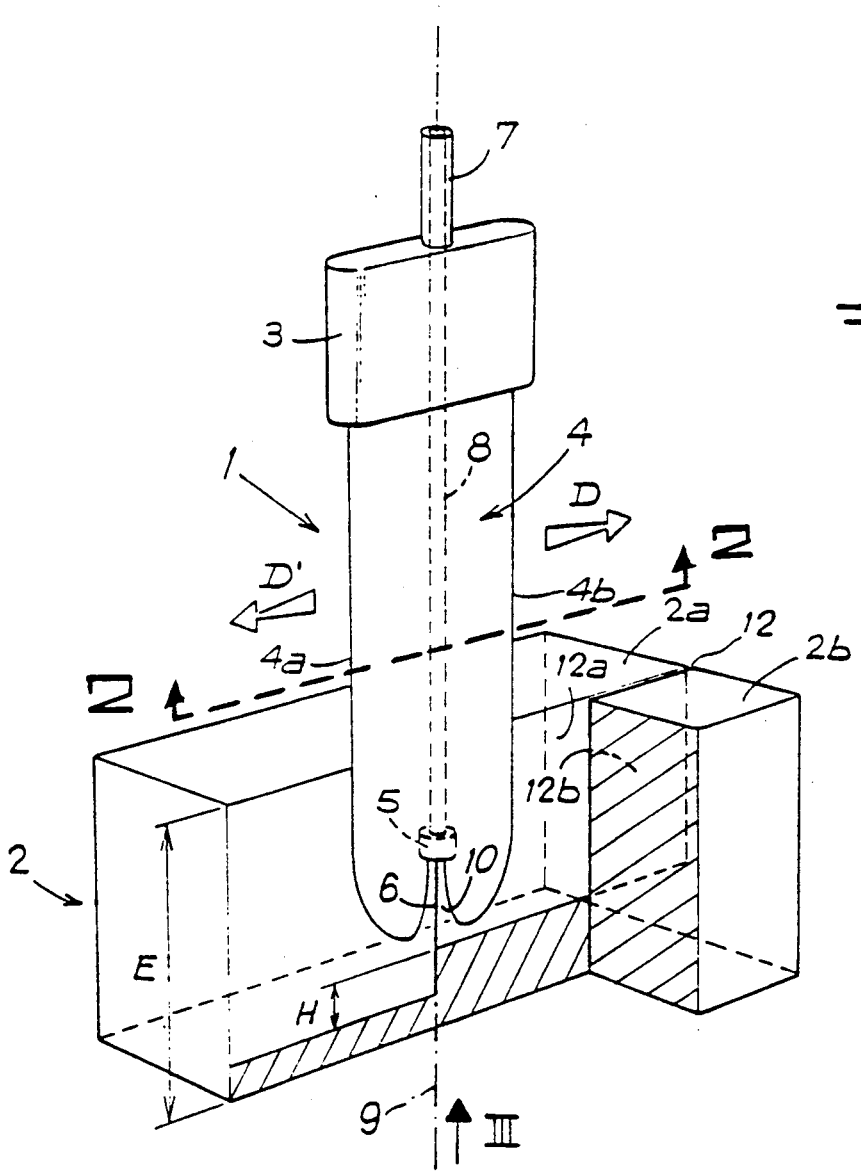
FIG. 1
FIG. 2
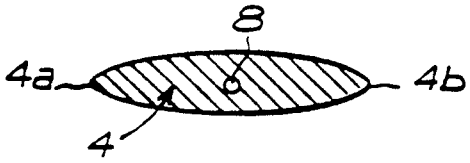
FIG. 3
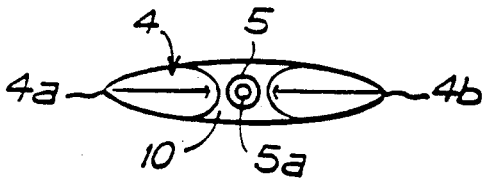

METHOD AND APPARATUS FOR CUTTING UP FIXED LAYERS OF FLEXIBLE MATERIAL USING A HIGH PRESSURE WATER JET

The invention relates to a method and apparatus for cutting up thick layers of flexible material, e.g. having a fibrous texture, with a jet of water at high pressure.

BACKGROUND OF THE INVENTION

Several techniques are known for cutting up soft texture layers, in particular fibrous layers for obtaining preforms in the manufacture of composite parts.

For thin sheets (about 1 mm thick) such as laminated cloth made of carbon, silicon carbide, or Kevlar fibers, various techniques are used without difficulty, and according to circumstances these techniques may be stamping, laser cutting, ultrasound, or high pressure water jet.

Difficulties appear when the thickness of the layer increases to reach a few cm. Laser cutting gives rise to considerable heating with the risk of oxidizing the material constituting the layer being cut up; a water jet with a conventional nozzle ceases to be effective; and punching suffers from the drawback of deforming the layer by crushing it under the compression effect that precedes the cutting process per se and also of requiring the tooling to be sharpened regularly.

For cutting up thick layers (more than 2 cm or 3 cm thick), e.g. carbon felts, it is the practice to use diamond wire or tape saws.

The object of the invention is to enable layers of medium or high thickness to be cut up using a high pressure water jet.

SUMMARY OF THE INVENTION

This object is achieved by means of a method which consists in performing cutting in a plurality of successive passes, possibly with the device that emits the high pressure water jet being gradually lowered through the thickness of the layer, while constantly ensuring that the jet is isolated from the flanks of the cut already made over a fraction of the total thickness of the layer. This serves to avoid the jet being dispersed against the flanks of the cut so that it conserves all of its energy for attacking the new deeper level of the thick layer to be cut up. Thus, in theory, there is no limit on the thickness of the layer that can be cut up by means of a water jet. In practice, the method can be used to cut up fibrous texture layers having a thickness of up to 50 cm, and even more in some cases.

The invention also provides apparatus for implementing the novel method. This apparatus includes a base carrying a nozzle fed with water under pressure and emitting an ultrafast fine cutting water jet and is also provided with a specially shaped blade fixed to the base; this blade extends longitudinally along the nozzle emission axis; its mean plane contains said axis and its shape is such that starting from a thick longitudinal zone adjacent to said axis it tapers laterally on at least one side of the above-mentioned axis to a sharp edge parallel or substantially parallel to said axis, whereas longitudinally the blade terminates in a tip of reduced thickness.

The shaped blade of the apparatus of the invention is oriented so that its mean plane is parallel to the direction of relative motion between the apparatus and the layer to be cut up, and it penetrates into the cut formed during the preceding cutting pass or passes, keeping the walls of the cut away from the vicinity of the jet, thereby preserving the jet from any untimely contact that could reduce its effectiveness. The blade also serves to separate the flanks of the cut to provide a passage between the flanks for the nozzle, with the extent to which the flanks are separated being kept as small as possible in order to limit the friction due to the reaction of the texture of the layer tending to close the cut.

In the vicinity of the tip of the blade at a distance from the base, it is advantageous for the, or each, of the above-mentioned cutting edge(s) to curve towards the axis of the nozzle so that said tip forms a point. This disposition facilitates inserting the blade into a cut.

The blade may be formed in two different shapes. In one shape the blade is situated entirely on one side of said axis and it includes only one cutting edge. In the other shape the blade has two cutting edges and it tapers away on either side of said thicker zone towards each of them. This shape allows the cutting apparatus to perform reciprocating motion relative to the layer being cut up, whereas the first shape is usable only where the direction of relative motion is always the same.

The blade may be constituted by a single piece, or else by an assembly of two complementary pieces disposed on respective sides of the nozzle axis.

The nozzle may either be mounted in the region of the end of the blade which is close to the base, with the blade preferably being removably mounted on the base to which the nozzle is then fixed, and the blade including a longitudinal channel surrounding the nozzle axis at a distance therefrom to provide a free passage for the jet along the length of the blade, or else the nozzle may be mounted in the region of the reduced-thickness tip of the blade at a distance from the base, in which case a pressurized water feed duct for the nozzle is provided inside the blade. If necessary, in the second case, the said reduced-thickness tip of the blade may project from a swelling which is dimensioned so as to be able to receive the nozzle, in the event that the nozzle is wider than the thickness of the blade. In addition, the reduced-thickness tip of the blade at a distance from the base may be provided with a jet-passing notch.

BRIEF DESCRIPTION OF THE DRAWINGS

Embodiments of the invention are described by way of example with reference to the accompanying drawings, in which:

FIG. 1 is a perspective view of cutting apparatus of the invention fitted with a two-edged blade;

FIG. 2 is a cross-section through the blade of the FIG. 1 apparatus;

FIG. 3 is an end view along arrow III of the blade of the FIG. 1 apparatus;

DETAILED DESCRIPTION

Figure 4:
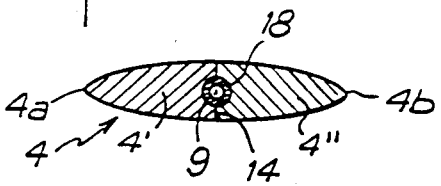
FIG. 4 is a cross-section through a variant embodiment of the blade of the FIG. 1 apparatus.

FIG. 1 shows pressurized water jet cutting apparatus 1 used for cutting a thick layer 2 of fibrous texture into two blocks 2*a* and 2*b*. The apparatus 1 comprises a base 3 for fixing to a mechanism suitable for imparting translation motion relative to the fibrous layer 2 along a direction D or D', a blade 4 fixed to the base 3 or integrally formed therewith as in the example shown, and a nozzle 5 incorporated in the blade 4 not far from its end furthest from the base 3, the nozzle being suitable for emitting an ultrafast fine cutting jet 6 of water via a narrow nozzle hole 5*a* (FIG. 3) when supplied with water under pressure via a connection pipe 7 and a duct 8 formed through the base 3 and the blade 4. Over a major portion of its length, the blade has the shape of a flattened cylinder of shuttle-shaped cross-section (FIGS. 2 and 3) and the longitudinal axis 9 of the blade coincides with the cutting jet 6. The blade 4 thus has a relatively thick middle portion between two tapering portions that terminate in sharp edges 4*a* and 4*b* lying in the midplane of the blade. These edges extend a little beyond the nozzle 5 in the form of a pointed tip of reduced thickness where the two edges 4*a* and 4*b* curve towards the axis 9, with a notch 10 being formed therebetween to allow the jet 6 free play on leaving the nozzle 5.

The apparatus shown is designed for cutting up a thick fibrous layer 2 having thickness E which is greater than the thickness H that the jet 6 is capable of cutting in a single pass, with the value of the thickness H depending on the cutting performance of the jet 6 for the particular texture of the layer 2. The layer is thus cut up in a plurality of successive passes formed by moving the apparatus 1 in translation alternatively in the direction of arrow D and then in the opposite direction (arrow D'). After each cutting pass, the device whose blade 4 is oriented so that its mean plane lies parallel to the displacement direction D or D' is lowered by a further distance H with the blade 4 and the nozzle 5 penetrating in the cut 12 previously made in the layer 2. The flanks 12*a* and 12*b* of the cut which have a natural tendency to close against each other, thereby severely disturbing the jet 6, are thus kept apart by the blade 4 in the vicinity of the jet.

In the example shown in FIGS. 1 to 3, the blade 4 is a single piece through which the duct 8 for feeding the nozzle 5 has been drilled. In a variant, the blade 4 could be built up from two symmetrical pieces 4' and 4'' (FIG. 4) each including one of the two edges 4*a* and 4*b*, with the two pieces being assembled to each other on a join plane 14 that includes the nozzle axis 9. In this case, the nozzle should be fed via a tube 18 received in a longitudinal recess formed in each of the pieces 4' and 4'' constituting the blade 4. These pieces may be made of sintered ceramic or of a ceramic composite.

Figure 5A:
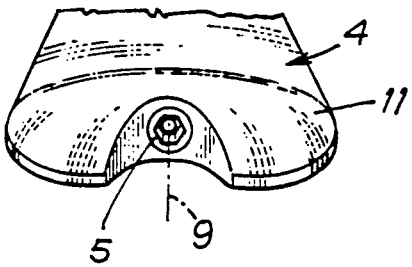
FIGS. 5A and 5B are respectively a perspective view and a longitudinal section through the end of a variant embodiment of the blade of the FIG. 1 apparatus arranged to receive a relatively large nozzle.
Figure 5B:
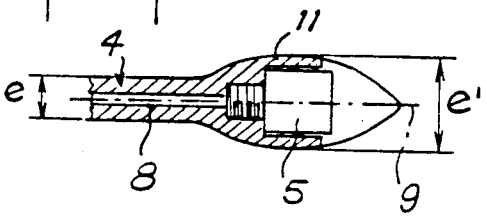

When the diameter of the nozzle 5 is greater than the thickness e of the thickest portion of the blade 4 (FIGS. 5A and 5B) then the end of the blade 4 may be shaped so as to present a swelling 11 of thickness e' which is slightly greater than said diameter, thereby constituting a fairing in which the nozzle 5 may be housed and installed by screw engagement, for example. In practice, the thickness e of the blade 4 should be no greater than 3 mm, and the thickness e' of the swelling 11 should not exceed 6 mm.

Figure 6:
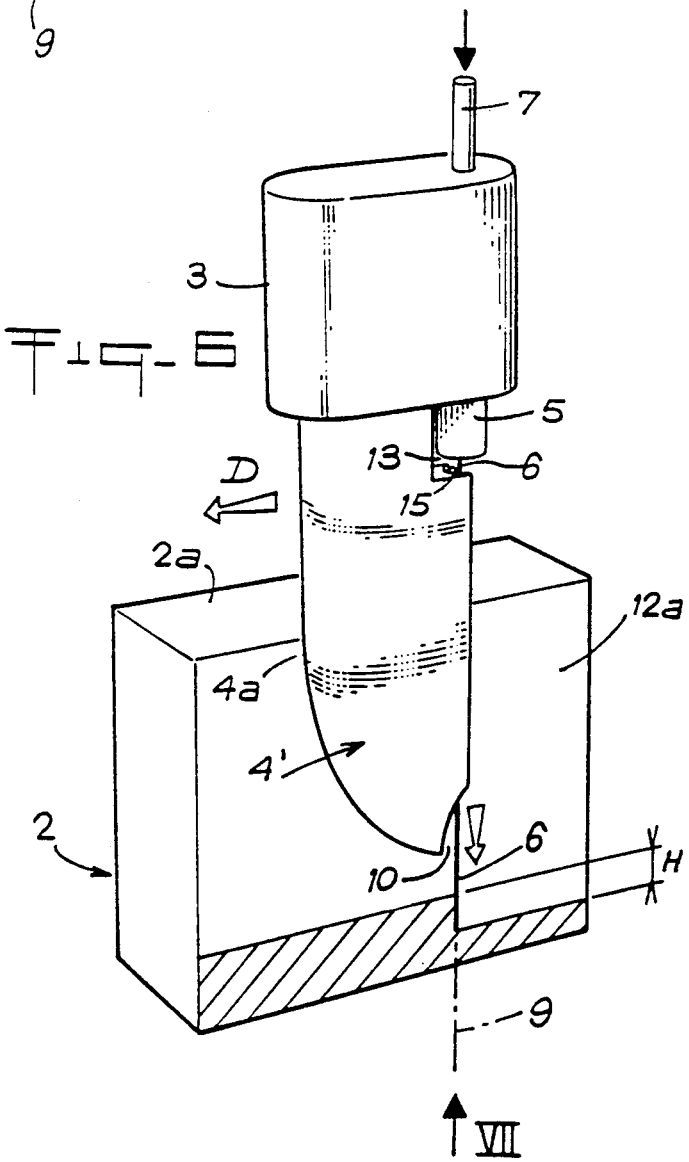
FIG. 6 is a view similar to FIG. 1 showing a variant embodiment of apparatus of the invention.
Figure 7:
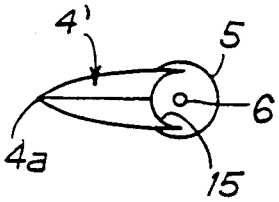
FIG. 7 is an end view along arrow VII of the blade of the FIG. 6 apparatus.

A variant embodiment is shown in FIG. 6 which shows cutting apparatus which is not fitted with a two-edged blade 4 but which is fitted with a blade 4' comprising one of the two component pieces of the blade shown in FIG. 4. This blade 4' is situated entirely on one side of the cutting jet 6 and is suitable for use when the apparatus is always displaced in the same direction relative to the layer 2 as shown by arrow D, with the edge 4*a* then always being ahead of the cutting jet 6, relative to the direction of movement indicated by arrow D. In addition, the blade 4' of the embodiment of FIG. 6 may be dismountable.

Further, the nozzle 5 in the FIG. 6 apparatus is no longer placed in the vicinity of the end of the blade furthest from the base 3, but is placed in a location close to the base. More precisely, the nozzle 5 is fixed to the base 3 occupying a notch 13 formed in that end of the blade 4' which is fixed to the base 3. In this case, the nozzle 5 does not penetrate into the layer 2 and the jet 6 which it emits must run along the entire length of the blade 4'. The jet 6 runs along the blade in a gutter-shaped channel 15 formed in the blade 4', thereby preventing it from coming into contact with the flanks 12*a* and 12*b* of the cut 12 into which the blade 4' is inserted. A notch is similarly formed at the end of the blade through which the jet 6 emerges.

In practice, the FIG. 6 apparatus is used to make a first cutting path with the blade 4' removed, and then after the blade has been put back on the base 3, with its tip penetrating into the cut formed during the first pass, a second pass is performed without lowering the apparatus so as to cut the layer over an additional thickness.

Placing the nozzle 5 in the vicinity of the base 3 has the advantage of making it possible to use a common type of commercially available nozzle. However, it does require a polymer to be added to the nozzle water feed in order to prevent the jet dispersing. Further, it gives rise to cutting depths which are smaller than those which can be obtained using the first version (FIG. 1).

Figure 8:
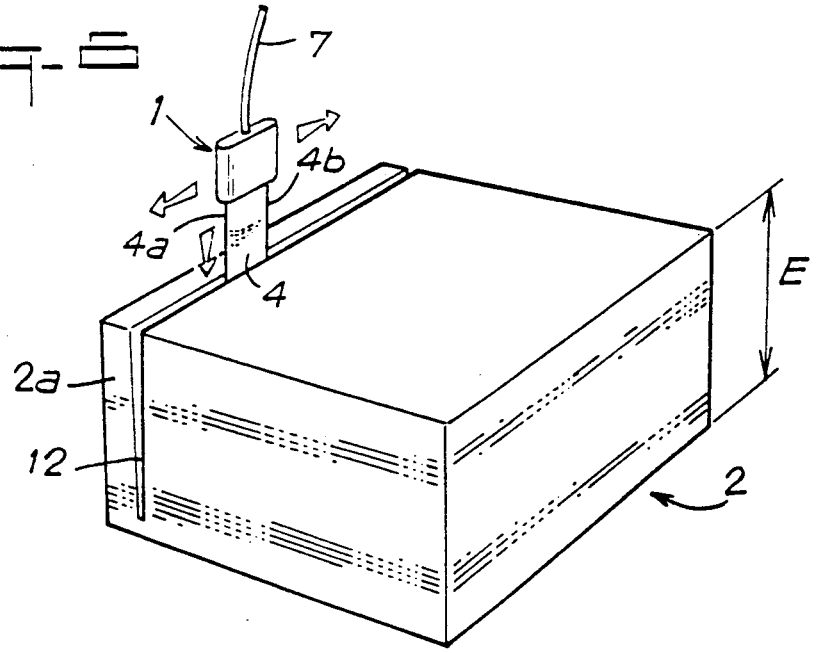
FIGS. 8 to 10 are simplified perspective views showing three ways in which the apparatus of the invention can be used.
Figure 9:
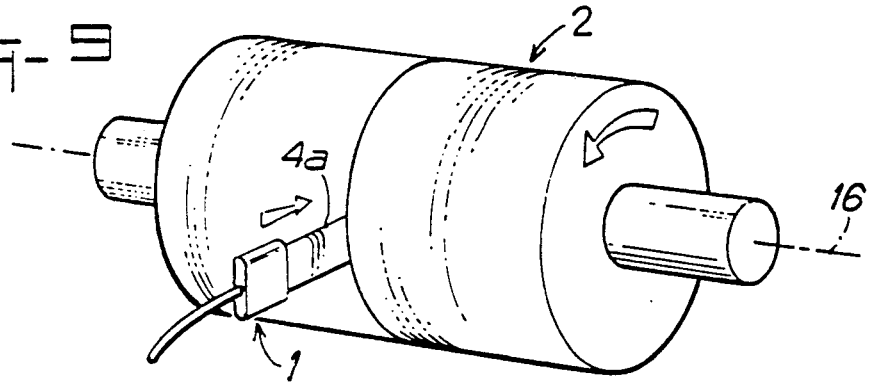
Figure 10:
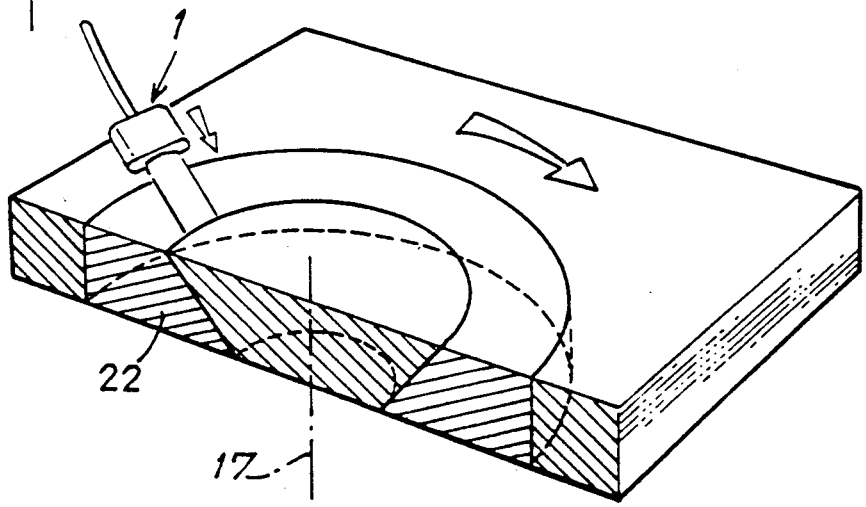

FIGS. 8 to 10 show examples of how the above-described cutting apparatus can be used. FIG. 8 shows a block 2*a* being cut off a stationary layer 2 of considerable thickness E by means of a reciprocating apparatus 1 fitted with a blade 4 having two edges 4*a* and 4*b*.

FIG. 9 shows a thick cylindrical layer 2 driven to rotate about its axis 16 and being cut up into slices while the apparatus 1 remains stationary. In this case, a simplified blade as shown in FIG. 6 may be used. A battery comprising a plurality of apparatuses 1 (e.g. about 10) may be provided distributed along the axis 16 of the cylindrical layer 2 so as to cut a plurality of slices therein simultaneously.

FIG. 10 shows how a plane thick layer 2 having rotary drive applied thereto may be cut to form a body of revolution 22 about an axis 17, the outside surface of the body being a right cylinder and its inside surface being frustoconical.

We claim:

1. A method of cutting up a thick, flexible material, said method comprising the steps of:

providing a thick layer of flexible material;

providing a cutting apparatus comprising a nozzle that emits an ultrafast, fine cutting jet of water when fed with water under pressure;

passing said cutting apparatus across said thick layer of flexible material, while said nozzle is emitting said cutting jet, so that said jet makes a cut through a fraction of the total thickness of said layer, said jet forming flanks at the sides of said cut in said layer; and making a plurality of successive passes of said jet-emitting cutting apparatus across said cut in said thick layer of flexible material while isolating said jet from the flanks of the cut already formed in said layer, whereby said cut is deepened and a cut having a depth equal to the total thickness of said layer is made through said flexible material without causing disintegration of said material.

2. The method of claim 1 further including the step of lowering the cutting apparatus after each successive pass of said apparatus across said cut.

3. High pressure water jet cutting apparatus for cutting up a thick layer of flexible material, said apparatus comprising a base, said base comprising a nozzle that emits an ultrafast, fine cutting jet of water when fed with water under pressure; and a generally flat blade extending longitudinally along the emission axis of the nozzle, said blade comprising a region adjacent said base and a region at a distance from said base, wherein the means plane of the blade contains said axis, wherein said blade tapers laterally on at least one side of said axis form thick longitudinal zone in the vicinity of said axis to a sharp edge substantially parallel to said axis, and wherein said bade is terminated longitudinally at a distance from the base by a tip of reduced thickness, said tip comprising a region adjacent said sharp edge and a region substantially in said thick longitudinal zone.

4. The apparatus of claim 3 wherein said edge has a region adjacent said tip at a distance from said base and said edge is curved in said region adjacent said tip towards said emission axis, thereby causing said tip to be in the form of a point.

5. The apparatus of claim 4 wherein the blade is made as an assembly of two complementary pieces disposed on respective sides of the nozzle axis.

6. The apparatus of claim 3 wherein the blade is entirely situated on one side of said axis and has only one edge.

7. The apparatus of claim 3 wherein the blade has two edges and tapers away from either side of said longitudinal zone towards each of said edges.

8. The apparatus of claim 3 wherein the blade is made as a single piece.

9. The apparatus of claim 3 wherein the nozzle is mounted in the region of the blade adjacent the base and wherein the blade includes a longitudinal channel surrounding the nozzle emission axis at a distance therefrom and leaving a free passage for the jet along the length of the blade.

10. The apparatus of claim 9 wherein the nozzle is fixed to the base and the blade is removably mounted to the base.

11. The apparatus of claim 3 wherein the nozzle is mounted in the region of the blade at a distance from the base and wherein a duct is provided inside the blade for feeding the nozzle with water under pressure.

12. The apparatus of claim 11 wherein said blade tip of reduced thickness is adjacent a region of swelling of the blade of dimensions suitable for housing the nozzle.

13. The apparatus of claim 3 wherein the blade has a longitudinally extending notch in said tip of reduced thickness, said notch leaving free passage from said jet.

* * * * *

UNITED STATES PATENT AND TRADEMARK OFFICE

CERTIFICATE OF CORRECTION

PATENT NO. : 5,097,731

DATED : March 24, 1992

INVENTOR(S) : Michel Vives, et al.

It is certified that error appears in the above-identified patent and that said Letters Patent is hereby corrected as shown below:

Column 4, line 23, "A notch is similarly formed" should read --A notch 10 is similarly formed--.

Column 5, line 24, "axis form thick" should read --axis from a thick--.

Signed and Sealed this

Twenty-sixth Day of October, 1993

Bruce Lehman

*Attest:*

BRUCE LEHMAN

*Attesting Officer*

*Commissioner of Patents and Trademarks*